US008955228B2

(12) United States Patent
Eichhorn et al.

(10) Patent No.: US 8,955,228 B2
(45) Date of Patent: Feb. 17, 2015

(54) SYSTEM CONSISTING OF A SMALL ELECTRICAL DEVICE AND AN AUXILIARY ELECTRICAL DEVICE ASSIGNED THERETO

(75) Inventors: Reinhold Eichhorn, Idstein (DE); Detlef Gleich, Friedrichsdorf (DE); Sebastian Hottenrott, Idstein (DE); Peter Junk, Seelenberg (DE); Christof Kleemann, Eschborn (DE); Michael Odemer, Niddatal-Assenheim (DE); Thorsten Pohl, Mühlheim (DE); Tobias Schwarz, Schmitten (DE); Jürgen Wolf, Kriftel (DE)

(73) Assignee: Braun GmbH, Kronberg (DE)

( * ) Notice: Subject to any disclaimer, the term of this patent is extended or adjusted under 35 U.S.C. 154(b) by 2056 days.

(21) Appl. No.: 10/552,555

(22) PCT Filed: Feb. 13, 2004

(86) PCT No.: PCT/EP2004/001373

§ 371 (c)(1), (2), (4) Date: May 26, 2006

(87) PCT Pub. No.: WO2004/089152

PCT Pub. Date: Oct. 21, 2004

(65) Prior Publication Data

US 2006/0277758 A1 Dec. 14, 2006

(30) Foreign Application Priority Data

Apr. 12, 2003 (DE) ..... 103 16 935

(51) Int. Cl.
*B26B 19/38* (2006.01)
*A45D 27/46* (2006.01)

(52) U.S. Cl.
CPC ..... *B26B 19/3833* (2013.01); *A45D 27/46* (2013.01); *B26B 19/3873* (2013.01); *Y10S 30/01* (2013.01)
USPC ..... 30/538; 30/541; 30/DIG. 1; 320/115; 134/166 R

(58) Field of Classification Search
USPC ..... 30/537, 538, 41, 41.5, 541, DIG. 1; 132/292; 134/92, 111, 186, 166 R; 320/114–115; 312/209, 223.1; 206/351, 208, 459.1
See application file for complete search history.

(56) References Cited

U.S. PATENT DOCUMENTS 3,283,185 A * 11/1966 Somers et al. ..... 310/47
3,379,952 A * 4/1968 Tarrson ..... 320/115
(Continued)

FOREIGN PATENT DOCUMENTS

| | | |
|---|---|---|
| DE | 44 02 237 | 1/1994 |
| EP | 0 601 232 | 6/1994 |
| WO | WO 98/25736 | 6/1998 |

*Primary Examiner* — Laura M Lee
(74) *Attorney, Agent, or Firm* — Jay A. Krebs; David K. Mattheis

(57) ABSTRACT

A system comprising a primary electrical device, such as a shaver, and an auxiliary electrical device, such as a shaver cleaner, defining a receiving arrangement for receiving the primary electrical device. The primary electrical device includes a first connector configured to couple with an associated connector of the auxiliary device to transmit electrical or electromagnetic energy between the devices. The primary electrical device includes an additional connector configured to couple the primary electrical device for receiving electrical or electromagnetic energy, such as from an electric mains voltage.

6 Claims, 1 Drawing Sheet

(56) References Cited

U.S. PATENT DOCUMENTS

| | | | | | |
|---|---|---|---|---|---|
| 3,659,180 | A | | 4/1972 | Urbush | |
| 3,710,224 | A | * | 1/1973 | Daniels | 320/115 |
| 5,159,256 | A | * | 10/1992 | Mattinger et al. | 320/115 |
| 5,189,792 | A | * | 3/1993 | Otsuka et al. | 30/43.92 |
| 5,321,349 | A | * | 6/1994 | Chang | 323/297 |
| 5,614,030 | A | * | 3/1997 | Braun | 134/22.1 |
| 5,894,670 | A | * | 4/1999 | Iso et al. | 30/541 |
| 6,424,118 | B1 | | 7/2002 | Tu | |
| 6,430,813 | B2 | * | 8/2002 | Muraguchi et al. | 30/43.92 |
| 7,107,692 | B2 | * | 9/2006 | Kappes et al. | 30/538 |
| 7,150,285 | B2 | * | 12/2006 | Saito et al. | 134/100.1 |
| 7,316,236 | B2 | * | 1/2008 | Hoser | 134/166 R |
| 7,361,232 | B2 | * | 4/2008 | Chasen et al. | 134/10 |
| 2002/0187756 | A1 | | 12/2002 | Chen | |
| 2006/0048802 | A1 | * | 3/2006 | Kappes et al. | 134/184 |

* cited by examiner

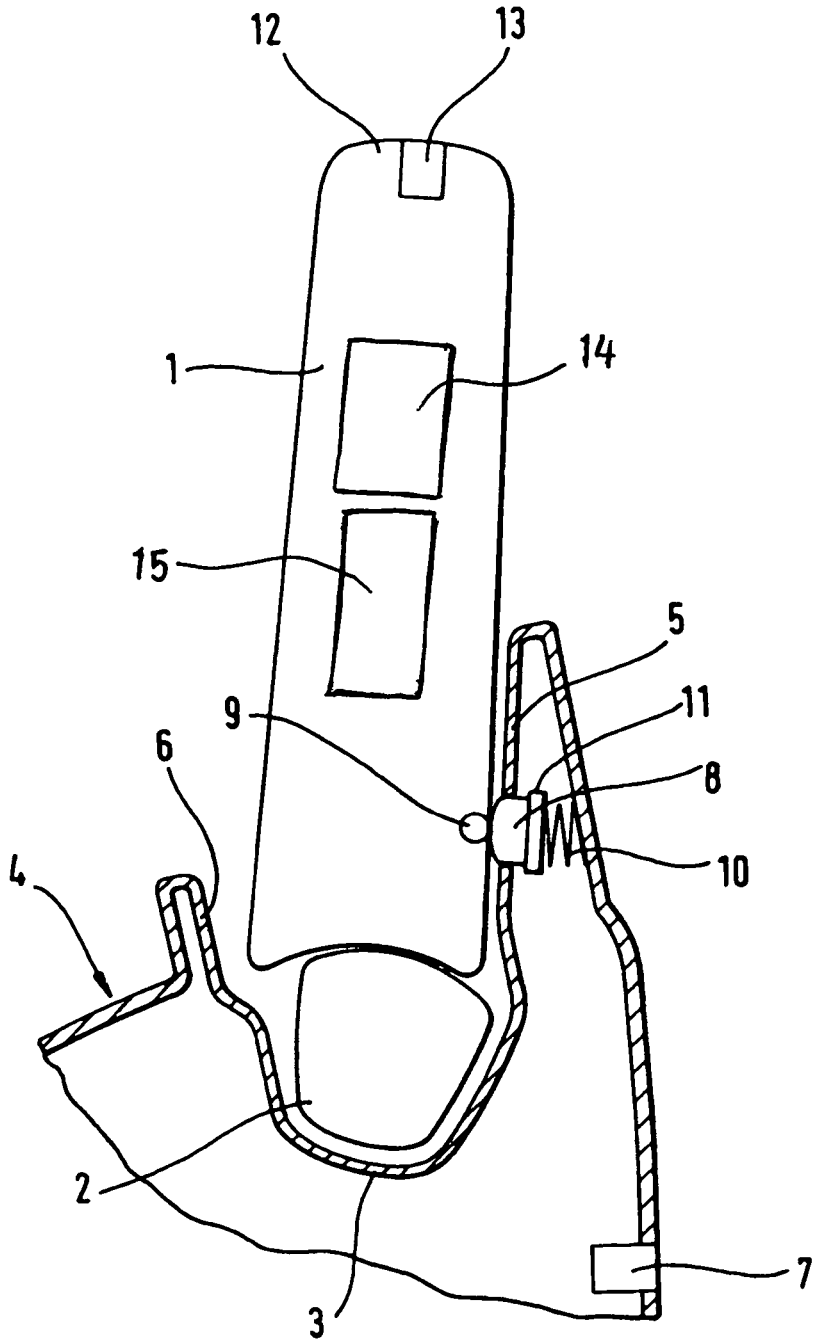
12
13
1
14
15
5
11
9
8
6
10
4
2
3
7

SYSTEM CONSISTING OF A SMALL ELECTRICAL DEVICE AND AN AUXILIARY ELECTRICAL DEVICE ASSIGNED THERETO

CROSS REFERENCE TO RELATED APPLICATIONS

This application is a national stage of PCT Application No. PCT/EP2004/001373, filed Feb. 13, 2004, which claims priority under 35 USC 119(a) from German Application Number 103 16 935.0, filed Apr. 12, 2003.

TECHNICAL FIELD

This invention relates to a system comprising a small electrical device and an auxiliary electrical device assigned thereto with a receiving arrangement for the small electrical device, each of said two devices being provided with corresponding first electrical or electromagnetic coupling elements for transmitting energy and/or information.

BACKGROUND

Systems of the aforementioned type are known in the art and can be constructed for diverse possible uses; for example, electrical hair clippers, electrical toothbrushes or electrical household appliances as small electrical devices can cooperate with an auxiliary device for charging, cleaning and/or diagnosis purposes. However, one disadvantage of small electrical devices with a separate charging station is that they do not allow mains operation, with the result that when the storage cell is depleted, no operation is possible until the charging cycle is completed. Another disadvantage is that the usually bulky and also heavy charging device has to be taken along as well on lengthy journeys in order to ensure operation of the small device and its supply of electrical energy.

As an example, a system of this type is described in DE 44 02 237 C1 which discloses a cleaning and charging device for a dry shaving apparatus. This device is used to clean the shaving head and to charge the electrical storage cells which are arranged in the dry shaving apparatus. For this purpose the dry shaving apparatus is inserted with its shaving head in a receiving part, which is then filled with a cleaning fluid. The cleaning fluid dislodges hair residues and deposits adhering to the shaving head, which are then conveyed together with the cleaning fluid back to a fluid container. During the cleaning operation the dry shaving apparatus is also put into operation temporarily in order to enhance the cleaning effect. For this purpose the dry shaving apparatus is electrically connected to the cleaning device. This connection is used not only to transmit electrical energy for operating the dry shaving apparatus and, where applicable, for charging the electrical storage cells, it can also be used to exchange information and control signals between the two devices.

Contact between the dry shaver and the cleaning device is established on the known system by way of the appliance socket on the dry shaver, which is connected to the electrical terminals in the cleaning device. The appliance socket is arranged on the end of the housing of the dry shaving apparatus remote from the shaving head; it also serves to connect a power cable. The electrical terminals of the cleaning device are arranged in the upper end of a contact dome where they can be moved by means of a pushbutton in the direction of the appliance socket on the dry shaving apparatus. With this contact arrangement the electrical terminals are held in this position by detent hooks; the dry shaving apparatus is then electrically connected to the cleaning device and mechanically locked. In this arrangement it is a disadvantage that the construction of the cleaning device and contact dome is very complex and expensive to manufacture and assemble. Furthermore, positional deviations or manufacturing tolerances can result in plugging or jamming problems when establishing the contact. An exact, smooth and hence convenient docking of the dry shaving apparatus onto the cleaning device with a reliable electrical contact then becomes difficult.

In addition, auxiliary devices constructed as charging stations for battery-driven small devices which make contact with the small electrical device either directly in electrically conducting manner or alternatively, by induction are also known.

It is therefore desirable to further improve upon a system of the type initially described.

SUMMARY

Various aspects of this invention include a primary electrical device having an additional coupling element configured to couple the primary electrical device for receiving electrical or electromagnetic energy.

For example, in one aspect, the invention provides a system comprising: a primary electrical device and an auxiliary electrical device defining a receiving arrangement for receiving the primary electrical device, wherein the primary electrical device includes a first connector configured to couple with an associated connector of the auxiliary device that to transmit electrical or electromagnetic energy between the devices; and wherein the primary electrical device includes an additional connector configured to couple the primary electrical device for receiving electrical or electromagnetic energy. In some cases, the energy transmits information.

In one embodiment, the additional connector is advantageously arranged at a location separate from the first connector.

In some cases, an automatic electrical or electromagnetic contact is established while positioning the primary electrical device in the receiving arrangement of the auxiliary device.

In some embodiments, the additional connector is an electrical plug-type connection. In some variations of this embodiment, the electrical plug-type connection is an appliance socket. In some cases, the first and associated connectors are corresponding electrical contact elements. In addition, in some variations of this embodiment, at least one of the electrical contact elements is resiliently constructed.

Alternatively, in some embodiments, the first and associated connectors are corresponding inductive energy elements. In some embodiments, the primary electrical device comprises a dry shaving apparatus including a shaving head and the auxiliary device is a cleaning and charging station. In some implementations of this embodiment, the first connector is arranged in close proximity to the shaving head and the additional connector is arranged on an end of the dry shaving apparatus at a remote distance from the shaving head.

In another aspect, the invention features, in combination, a handheld personal care appliance and an associated auxiliary device; wherein the personal care appliance comprises: a housing; an electrical motor contained within the housing; and a battery electrically connected to the motor; the auxiliary device defining a receptacle configured to receive the personal care appliance therein; wherein the housing of the personal care appliance includes a first connector that couples with an associated connector of the auxiliary device to transmit electrical or electromagnetic energy between the auxiliary device and the personal care appliance; and wherein the personal care appliance includes an additional connector, spaced apart from the first connector, and configured to connect the battery to an auxiliary power source. In some cases the additional connector is an electrical plug-type connection.

In some embodiments, the auxiliary device is a personal care appliance cleaner.

In some cases, coupling of the first and associated connectors takes place automatically while positioning the personal care appliance in the receptacle of the auxiliary device.

In some embodiments, the first and associated connectors include corresponding electrical contact elements. In some cases, the first and associated connectors include corresponding inductive energy elements.

In some embodiments, the personal care appliance comprises a dry-shaving apparatus including a shaving head and the additional connector is arranged on an end of the dry shaving apparatus at a remote distance from the shaving head.

In some cases, the electrical or electromagnetic energy transmitted between the auxiliary device and the personal care appliance transmits information. In some implementations, the information comprises a device type, a degree of soiling, or a frequency and duration of use. In some embodiments, the energy comprises an electrical signal that controls a cleaning process.

In yet another aspect, the invention features an electric shaver system comprising: a shaver having a shaving head; an electrical motor mechanically connected to the shaving head; and a battery electrically connected to the motor; and a shaver cleaner configured to hold a quantity of cleaning fluid and defining a trough-shaped receptacle configured to receive the shaving head of the shaver therein; wherein the shaver includes a first connector that couples with an associated connector of the shaver cleaner to transmit electrical or electromagnetic energy between the shaver cleaner and the shaver; and wherein the shaver includes an additional connector, spaced apart from the first connector, and configured to connect the battery to an auxiliary power source. In some cases, the additional connector is and electrical plug-type connection.

In some embodiments, the first and associated connectors are corresponding electrical contact elements. In other embodiments, the first and associated connectors are corresponding inductive energy elements.

In some cases, the electrical or electromagnetic energy transmitted between the shaver and the shaver cleaner comprises an electrical signal that controls a cleaning process. In addition, in some cases, the energy transmits information.

Other objects, features, advantages and application possibilities of the present invention will become apparent from the subsequent description of embodiments. It will be understood that any single feature or any combination of single features described or represented by illustration form the subject-matter of the present invention irrespective of their summary in the claims or their back-references.

DESCRIPTION OF DRAWINGS

FIG. 1 shows a schematic and greatly simplified representation of a dry shaving apparatus in a related cleaning and charging device.

DETAILED DESCRIPTION

The drawing shows a dry shaving apparatus 1 comprising a shaving head 2; an electrical motor 15, which is mechanically connected to the shaving head; and a battery 14, which is electrically connected to the motor; wherein the dry shaving apparatus 1 is inserted head first—in other words with its shaving head down—in the receiving arrangement 3 of the cleaning and charging device 4. Inside the receiving arrangement the shaving head 2 can be cleaned in known manner by means of a cleaning fluid. For this purpose the cleaning and charging device 4 includes a fluid container and suitable devices for conveying the fluid. For the sake of clarity of illustration, these devices and the related drives and their electrical supply are not shown in the drawing. Similarly, a possible device for drying the shaving head is not shown in the drawing.

The cleaning and charging device 4 is also used to charge the battery 14 of the dry shaving apparatus 1 if it is a battery-driven device. Another function of the cleaning and charging device 4 includes parking the dry shaving apparatus 1; in other words it also serves as a device holder adapted to be mounted optionally on a wall.

The receiving arrangement 3 is constructed in the shape of a trough, with the rear wall 5 being constructed to be somewhat higher than the front wall 6. The rear wall 5 also acts as support for the dry shaving apparatus 1 shown in the side view. The cleaning and charging device 4 has an electrical connection 7 which is constructed as an appliance socket from which it can be supplied with electricity from the mains. The electrical contact between the dry shaving apparatus 1 and the cleaning and charging device 4 is established via two contact buttons 8 (only one of which is illustrated) which are arranged in the rear wall 5 of the cleaning and charging device 4, and two corresponding contact elements 9 (only one of which is illustrated) which are integrated in one of the broad sides, i.e., the front or rear side, of the dry shaving apparatus 1. Both the contact buttons 8 and the contact elements 9 are of a spherical configuration. This facilitates the insertion of the dry shaving apparatus 1 in the cleaning and charging device 4, thus preventing the risk of catching. The contact buttons 8 are elastically biased and hence resiliently supported in the wall by means of a compression spring 10 acting in the direction of the dry shaving apparatus 1. Each contact button 8 has a circumferential collar 11 holding it securely captured. If no dry shaving apparatus is inserted in the receiving arrangement 3, this collar 11 rests against the wall 5 due to loading by the compression spring 10. When the dry shaving apparatus 1 is inserted, the pressure exerted by the contact element 9 urges the associated contact button 8 a little into the wall 5, proper electrical contact being always assured by the elastic bias.

On the one hand this electrical contact is used to transmit control signals and information between the dry shaving apparatus and the cleaning and charging device, enabling, for example, information about the device type, the degree of soiling and the frequency and duration of use to be transmitted as well as signals for controlling the cleaning process. In addition, the electrical contact is also used for transmitting energy for charging electrical storage cells that are integrated in the dry shaving apparatus 1, inasmuch as it is designed for battery operation.

As the result of the open, trough-shaped configuration of the receiving arrangement 3 and the absence of all obstructions such as a contact arm it is very easy and convenient to insert the dry shaving apparatus 1 in the cleaning and charging device 4. The cleaning and charging device can also be constructed in very compact form as the result. The electrical contact is established automatically after parking the dry shaving apparatus 1 in the receiving arrangement 3 and leaning it against the rear wall 5.

To be able also to operate the dry shaving apparatus 1 (for example when it is a pure mains device) or charge it independently of the cleaning and charging device 3, the dry shaving apparatus is equipped on its end 12 remote from the shaving head 2 with an appliance socket 13 through which it can be electrically contacted using a power cable. This appliance socket 13 corresponds preferably to the electrical connection 7 of the cleaning and charging device 4 so that one and the same power cable can be used both for operating the cleaning and charging device 4 and for operating the dry shaving apparatus 1 itself.

It will be understood, of course, that instead of the electrically conducting contact elements 9 and the contact buttons 8 it is also possible to provide for an electrical coupling between the dry shaving apparatus 1 and the cleaning and charging device 4 by means of inductive elements in accordance with an embodiment not shown in the drawing, in which case provision is made in both the dry shaving apparatus 1 and the cleaning and charging device 4 for coil arrangements known in the art.

What is claimed is:

1. An electric shaver system comprising:

a dry shaving apparatus including a shaving head; and a cleaning and charging station defining a receiving arrangement for receiving the dry shaving apparatus;

wherein the dry shaving apparatus includes a first connector configured to couple with an associated connector of the cleaning and charging station to transmit charging energy and control signals between the apparatus and station while the apparatus is received in the station;

wherein the dry shaving apparatus includes an additional connector, spaced from the first connector and configured to couple the dry shaving apparatus for receiving charging energy with the dry shaving apparatus removed from the cleaning and charging station; and wherein the cleaning and charging station has a socket for receiving a power cable to supply power to the cleaning and charging station, and wherein the additional connector of the dry shaving apparatus is configured to receive the power cable, such that the power cable can be selectively used for powering the cleaning and charging station and for powering the dry shaving apparatus separate from the cleaning and charging station.

2. The system according to claim 1, wherein the additional connector is an electrical plug-type connection.

3. The system according to claim 1, wherein the first connector is arranged in close proximity to the shaving head and the additional connector is arranged on an end of the dry shaving apparatus at a remote distance from the shaving head.

4. The system according to claim 2, wherein the plug-type connection comprises an appliance socket.

5. The system according to claim 1, wherein the first connector is configured to transmit charging energy, control signals and information between the dry shaving apparatus and the cleaning and charging station while the dry shaving apparatus is received in the cleaning and charging station.

6. The system according to claim 1, wherein the cleaning and charging station is configured to vertically receive the shaving head of the dry shaving apparatus in an open trough void of obstructions, the trough defined in part by a rear wall arranged to support the dry shaving apparatus in a leaning position, such that coupling of the first connector of the dry shaving apparatus with the associated connector of the cleaning and charging station is maintained by weight of the dry shaving apparatus leaning against the rear wall.

* * * * *